United States Patent [19]

Stoll et al.

[11] 4,436,434

[45] Mar. 13, 1984

[54] PNEUMATIC TIMER

[76] Inventors: Kurt Stoll, Lenzhalde 72, D-7300 Esslingen, Fed. Rep. of Germany; Hans-Heinrich Glättli, Seestrasse 252, CH-8700 Küsnacht, Switzerland

[21] Appl. No.: 401,668

[22] Filed: Jul. 26, 1982

[30] Foreign Application Priority Data

Jul. 28, 1981 [DE] Fed. Rep. of Germany ..... 3129663

[51] Int. Cl.[3] ..... G04B 1/26

[52] U.S. Cl. ..... 368/65; 137/624.11

[58] Field of Search ..... 368/62, 65, 89; 137/624.11; 335/61, 59; 417/46, 403

[56] References Cited

U.S. PATENT DOCUMENTS 4,104,602 8/1978 Fujita et al. ..... 335/61

4,108,249 4/1978 Lametre ..... 137/624.11

4,256,021 3/1981 Graninger ..... 335/61 X

FOREIGN PATENT DOCUMENTS 2204667 6/1972 Fed. Rep. of Germany .

*Primary Examiner*—Vit W. Miska

*Attorney, Agent, or Firm*—Flynn, Thiel, Boutell & Tanis

[57] ABSTRACT

A pneumatic timer has a bellows with a space inside it joined up with the outside atmosphere by way of an adjustable choke. For starting a timing operation, the bellows is compressed by a pneumatic actuator which is then automatically moved back so that the bellows' speed of motion back into its starting position is controlled by the choke adjustment. The end position of stretching of the bellows is sensed by a sensing unit. This sensing unit may furthermore be moved for adjustment in the axial direction of the bellows.

13 Claims, 4 Drawing Figures

PNEUMATIC TIMER

BACKGROUND OF THE INVENTION

The present invention is with respect to pneumatic timers or time delay relays having a housing in which there is a bellows acted upon by a spring force for keeping the bellows in a stretched out or pushed together condition, and a bellows driving unit by which, at the start of a timing operation, the bellows is stretched out or pushed together while taking in or letting off air through a valve opened by the driving unit, and then the bellows is moved back into its starting position by the spring force at a rate fixed by an adjustable choke joining up the space within the bellows with the outside atmosphere. When the bellows is back in its starting position, a sensing unit is worked which gives a signal.

A delay relay or timer on these lines is to be seen in German Offenlegungsschrift specification 2,204,667. Its adjustable choke is made up of a turning plate with a choke groove in one face thereof, the cross-section of the groove changing smoothly in a direction round the plate, which has its grooved face placed against a fixed plate having a hole therein running into the groove. By using such a choke with a grooved plate, time adjustment of the timer may be undertaken within a wide range. The groove in the plate may be designed to give a linear or a logarithmic change in time with a change in the angle of the grooved plate.

GENERAL OUTLINE OF THE INVENTION

One purpose of the present invention is that of making a further development of timers of the sort in question so that the range of adjustment timing is even further increased.

For effecting this purpose, and further purposes, in the invention there is a stop forming a single structure with the unit for sensing the end of motion of the bellows at the end of a timing operation, the stop being fixed to the housing so that it may be moved for adjustment in relation thereto in the direction in which the bellows is moved.

Looked at from an other angle, it may be said that in the timer of the present invention, the time may further be adjusted by changing the position of the part sensing the end of the bellows motion in the direction of changing of length of the bellows. This sort of adjustment of the time is frequently useful because it is undertaken without changing flow conditions through the choke. In fact, the outcome is a pneumatic RC-delay member with an adjustable time constant, in the case of which it is possible to make use of different parts of the path of motion of the bellows for control purposes.

Further useful developments of the invention will be seen in the claims.

To take an example of one such possible further development, the stop may take the form of a ring which is centered on the bellows axis, this design making certain that the free bellows end is squarely supported in its resting position.

As part of a still further development of the invention, the ring-like stop has a number of stop nosepieces or pins, for example three such nosepieces, which are equally spaced round the ring-like stop so as to be stretching out in a direction parallel to the bellows axis so that the free end of the bellows is supported in its resting position at a number of separate points.

It is possible for the stop to have a sensing duct opening towards the said end face of the bellows, by which this duct is opened and shut at its end, the outcome being a sensing unit which, in a very simple way, is made part of the stop so that there will be a trouble-free and direct reaction of the sensing unit when the bellows comes into its resting position.

In a further possible development of the invention, the sensing duct is designed running along a straight line through the stop and a cover part of the sensing system is air-tightly placed on the side of the stop opposite to the bellows, such cover part having a channel therein or groove, joining up with one end of the duct in the stop. This design makes it simpler for the stop and the sensing unit to be more readily produced.

As part of a still further possible design of the invention, the cover part has a choke therein, one end or side of the choke being joined with an air supply inlet, while the other side of the choke is joined up with the channel and a signal outlet opening, this further development of the invention being designed for working without any trouble conditions and taking the form of a fluidics sensing unit needing little space.

The pneumatic timer of the present invention may furthermore have connection pipes or unions, one for the signal outlet opening and the other for the air supply opening. These connection pipes are run through holes in a housing cover with play in such holes, the pipes furthermore being able to be moved along their axes.

This part of the invention is for profiting from the flexible nature of connection hoses for supplying the sensing unit and tapping its output signal, even on adjustment of the sensing unit. For this reason, it is not necessary to have connection pieces within the pneumatic timer before a change in position or adjustment of the sensing unit is possible.

For making it possible for the stop to be locked on the housing in a very simple way from the mechanical point of view, it is possible for the stop to have a support foot running parallel to the axis of the bellows and guided on one of the sidewalls of the housing, against which it is locked by a gripping part, which may be in the form of a gripping screw running through a slot, parallel to the bellows axis, in the sidewall of the housing.

Furthermore, for making certain that the bellows driving unit, acting against the spring force, takes up as little space as possible, the driving unit may have a single acting pneumatic actuator with a spring for moving it into its moved-out position and placed coaxially in relation to the bellows and opposite to the valve, which may be a let-off valve, at the one end of the bellows. A working space within the actuator may be joined up with a gage pressure air supply (in cases in which such space is on the side of the actuator's piston nearest to the bellows) or it may be joined up with a vacuum line in cases in which such space is on the side of the actuator's piston turned away from the bellows. Furthermore, the actuator may have a diaphragm in place of a piston.

LIST OF FIGURES AND DETAILED ACCOUNT OF WORKING EXAMPLES OF THE INVENTION

A more detailed account of the invention will now be given on the footing of working examples to be seen in the figures.

Figure 1:
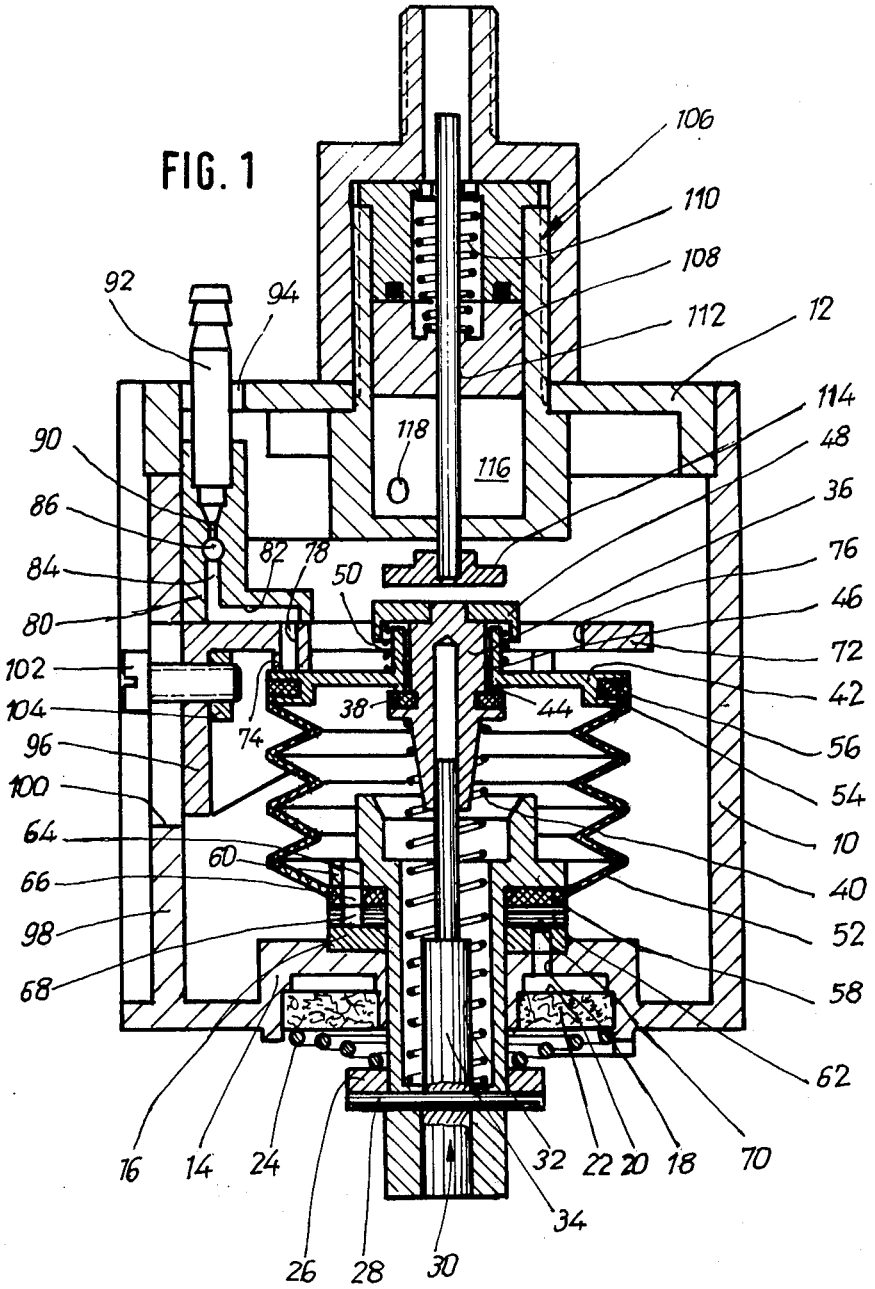
FIG. 1 is an axial section through a pneumatic timer on the section line I—I of FIG. 3.

Turning now to FIG. 1, it will be seen that a pneumatic time delay switch, timer or timer relay has a box-like housing 10, shut off at the top by a cover 12.

The lower wall of the housing has a middle, let-back wall part 14, running axially into the inside of the housing somewhat and on which a fixed-position choke plate 16 is adhesively joined, the plate 16 having a hole 18 running parallel to the axis of the timer and designed for the inlet of air, it having its lower end running into an inlet space 20, said space opening into the atmosphere through a filter plate 22. The filter plate 22 is kept in position by a compression spring 24 whose other end is supported on a ring 26, which, for its part, is locked onto an adjustment sleeve 30 by way of a cotter 28 running across and through sleeve 30.

Within adjustment sleeve 30 a spring space 32 will be seen, having a stepped guidepin 34 stretching through the middle thereof, that is to say on its axis.

On the top free end of guidepin 34, a valve body 36 (having a washer 38) is guidingly supported, the valve body 36 being acted upon by a coiled compression spring 40 (placed round guidepin 34 and housed within spring space 32) pushing the valve body 36 away from the adjustment sleeve 30 and towards an end plate 42, washer 38 functioning with a valve seat 44 formed round an opening 46 through the end plate 42. A top part of the valve body 36 is taken up with play in opening 46, it stretching through end plate 42. The top end of valve body 36 has a round plate 48 fixed thereon, which is acted upon by the top end of coiled compression spring 50, whose lower end is rested against the top side of end plate 42.

End plate 42 has the function of shutting off the top end of a bellows 52 of rubber and whose inwardly turned bead 54 is taken up in a channel 56 running round the edge of end plate 42 so that the bellows may be unjoined from the end plate, if desired. At the lower end, bellows 52 is so molded as to have an end wall 58 which is air-tightly gripped between a radial lip 60 of the adjustment sleeve 30 and a choke groove plate 62. In-line holes 64, 66 and 68 in lip 60, the end wall 58 and the choke groove plate 52 are responsible for making a connection between the space inside bellows 52 and a choke groove formed in the lower side of the choke groove plate 62 and running round the middle point thereof. By turning adjustment sleeve 30, the working length of the part of the choke groove 70 placed between the holes 64, 66 and 68 and a further hole 18 may undergo adjustment as desired, that is to say be changed.

Because of the effect of the compression coiled spring 40, the bellows 52 is acted upon by a force so that there is a tendency for the space inside the bellows to be increased in size. A ring-like stop 72, designed for use with the end plate 42 of the bellows 52, has three stop pins 74, running out axially in a downward direction and spaced from each other by 120° and furthermore a middle opening 76 for freely taking up the valve system supported by the end plate 42.

In one of the stop pins 74, an axially-running sensing duct 78 is present, running through to the top side of the ring-like stop 72 and opening into a channel 82 or groove formed in the lower side of a cover part 80 or sensing housing. Cover part 80 is made of steel and has its lower side strongly adhesively joined to the top side of the ring-like stop 72, which, for its part, is made of synthetic resin.

Figure 3:
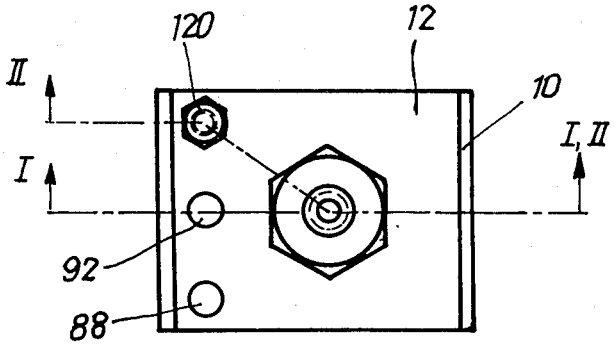
FIG. 3 is a plan view of the timer or delay relay of FIG. 1.

The sensing duct 78 is joined up by way of channel 82 and an upright connection opening 84 with a horizontal connection branch 86, which, for its part, goes into a signal output opening 88 (see FIG. 3). Connection branch 86 is furthermore joined up by way of a choke 90 with an inlet connection pipe 92, designed to be joined up with a compressed air line and running, with play, through an opening 94 in cover 12. This is to make certain that the space inside the housing 10 is joined up with the outside atmosphere while at the same time the inlet connection pipe 92 may be moved in an axial direction without anything in its way, the same being true for a signal output connection pipe, joined up with the signal output opening 88, which, again, is supported by the cover part 80.

On the ring-like stop 72 there is, at its edge, a support foot 96 running in the axial direction and guided against a sidewall 98 of housing 10. Sidewall 98 has an upright slot 100 therein, taking up the stem of a gripping screw 102. The head of such screw 102 is rested against the outer face of sidewall 98, while its threaded end is taken up in a metal nut 104 acting against the inner side of foot 96.

Figure 2:
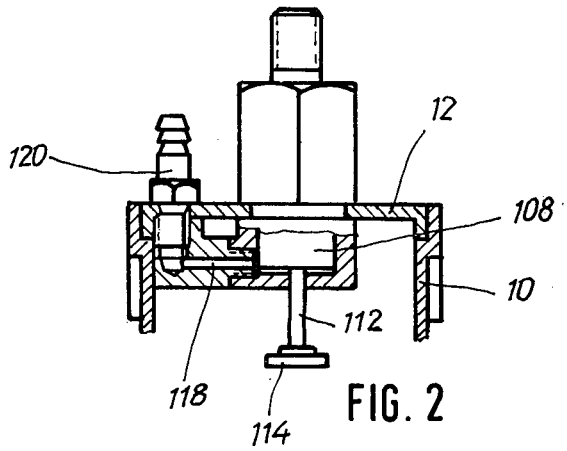
FIG. 2 is an axial section through the bellows driving unit or cocking system of the timer of FIG. 1 on a smaller scale along the II—II section line of FIG. 3, the bellows driving unit being presented in the position it goes into after pushing the bellows together.

A single-acting pneumatic actuator 106 is supported by cover 12, the piston 108 of the actuator being acted upon downwardly by a compression coiled spring 110 and the piston rod 112, joined with piston 108 has a driving plate 114 on its free end, which is moved downwards against the top face of valve body 36. The working space 116 under piston 108 in the cylinder of the actuator is joined up by way of an inlet hole 118 (see furthermore FIGS. 2 and 3) with a supply connection part 120.

Figure 4:
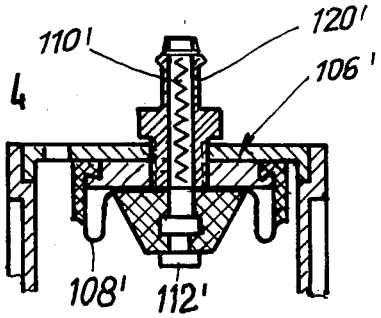
FIG. 4 is an axial section through a somewhat changed form of bellows driving unit for the timer of FIG. 1.

In FIG. 4 a somewhat changed form of actuator 106′ will be seen using a diaphragm 108′ in place of a piston. The middle part of such diaphragm is made stiffer by a rubber body 122. Rubber body 122 has a head 112′, which is pushed by actuator 106′ against the stop of valve body 36. Actuator 106′ is again acted upon by a compression coiled spring 110′ with a tendency of moving it into a moved-out position. Head 112′ may be moved upwards, that is to say inwards, when diaphragm 108′ is acted upon by vacuum by way of inlet pipe 120′.

ACCOUNT OF OPERATION OF THE INVENTION

The resting condition of the timer is to be seen in FIG. 1. By joining up space 116 under the piston with a vacuum line, the driving plate 114 is moved downwards, it then pushing against the valve body 36 so that washer 38 is moved clear of valve seat 44. On further downward motion of the driving plate 114, bellows 52 is pushed together or compressed so that the air within it is let off freely through opening 46. The working space 116 is now joined up with the compressed air line and driving plate 114 is lifted back upwards again. In the first part of the upward motion of driving plate 114, washer 38 will again be moved up against valve seat 44. The bellows will now be stretched out by the force of the compression coiled spring 40, the rate of such stretching being controlled by the rate of inlet of air through the acting part of choke groove 70, the selection of such acting groove part having been fixed earlier on by turning adjustment sleeve 30 into the right position. Bellows will now be stretched out slowly back into its starting position, that is to say till end plate 42 comes up against the stop pin 54 and at this point in time sensing duct 78 will be shut off, this being responsible for an increase in pressure in the signal output opening 88.

Adjustment of the time constant of the timer may be undertaken by twisting the adjustment sleeve 30, this changing the acting length of the choke groove 70 or by moving the ring-like stop 72 together with the cover part 82 axially after undoing the gripping screw 102 somewhat.

We claim:

1. A pneumatic timer having a housing, a bellows supported by said housing and able to be changed in length along a bellows axis with a change in the amount of air within a space in the said bellows, a spring for causing a change in length of said bellows with motion thereof along said axis, an air valve joining said space within said bellows with the atmosphere, a bellows driving unit for opening said valve and producing a change in the length of said bellows along said bellows axis against said spring with an exchange of air between the space inside said bellows and the atmosphere, said driving unit then moving into a starting position thereof, an adjustable choke joining said bellows space with the atmosphere, a sensing unit for sensing the end of a change in the length of said bellows as produced by said spring, and a stop for limiting motion of said bellows as produced by said spring, said stop and said sensing unit being a one-piece structure, said stop being adjustably fixed to and in said housing so that it may be moved along said axis.

2. The timer as claimed in claim 1, wherein said stop is ring-like and is centered on said axis.

3. The timer as claimed in claim 2, wherein said ring-like stop has nosepieces against which an end face of said bellows may come to rest when it has been changed in length by said spring.

4. The timer as claimed in claim 1, wherein said stop has a sensing air duct therein, said duct having an end opening pointing towards an end face of said bellows and designed to be shut off by the same when a change in length of said bellows caused by said spring has been completed.

5. The timer as claimed in claim 4 having said sensing duct running along a straight line through said stop and having a cover part air-tightly placed against said stop, said cover part having a channel therein, running to one end of said duct.

6. The timer as claimed in claim 5, wherein said cover part has a choke therein, one side of said choke being joined with an air supply inlet and the other side thereof with said channel and a signal outlet opening.

7. The timer as claimed in claim 6, having connection pipes with the signal outlet opening and the air supply opening therein, said connection pipes stretching through a top part of said housing with play to let axial motion of said connection pipes take place in relation to said housing.

8. The timer as claimed in claim 1, claim 2 or claim 3, wherein said stop has a foot running parallel to said bellows axis, said housing having a sidewall and a gripping part for locking said foot at different positions along a line parallel to said axis on said sidewall.

9. The timer as claimed in claim 1, claim 2 or claim 3, wherein said stop has a foot running parallel to said bellows axis, said housing having a sidewall and a gripping screw for locking said foot at different positions along a line parallel to said axis, said gripping screw being taken up in the slot parallel to said bellows axis in said side housing wall.

10. The timer as claimed in claim 1, claim 2 or claim 3, wherein said bellows driving system is in the form of a single-acting pneumatic actuator positioned on the axis of said bellows opposite to said wall, said valve being placed at one end of said bellows.

11. The timer as claimed in claim 1, claim 2 or claim 3, wherein said bellows driving system is in the form of a single-acting pneumatic actuator positioned on the axis of said bellows opposite to said wall, said valve being placed at one end of said bellows, wherein said actuator has a piston and a system for causing a side of said piston on the bellows' side of said piston to be acted upon by vacuum.

12. The timer as claimed in claim 1, claim 2 or claim 3, wherein said bellows driving system is in the form of a single-acting pneumatic actuator positioned on the axis of said bellows opposite to said wall, said valve being placed at one end of said bellows, wherein said actuator has a piston and a system for causing a side of said piston turned away from said bellows of said piston to be acted upon by gage pressure.

13. The timer as claimed in claim 1, claim 2 or claim 3, wherein said bellows driving system is in the form of a single-acting pneumatic actuator with a diaphragm positioned on the axis of said bellows opposite to said wall, said valve being placed at one end of said bellows.

* * * * *